US009267228B2

(12) United States Patent
Kim et al.

(10) Patent No.: US 9,267,228 B2
(45) Date of Patent: Feb. 23, 2016

(54) LAUNDRY TREATING DEVICE

(75) Inventors: Na Eun Kim, Seoul (KR); Ki Chul Woo, Seoul (KR); Sung Ryong Kim, Seoul (KR); Dong Soo Lee, Seoul (KR); Sung Min Kim, Seoul (KR); Dong Won Kim, Seoul (KR)

(73) Assignee: LG ELECTRONICS, Seoul (KR)

( * ) Notice: Subject to any disclaimer, the term of this patent is extended or adjusted under 35 U.S.C. 154(b) by 1497 days.

(21) Appl. No.: 12/251,597

(22) Filed: Oct. 15, 2008

(65) Prior Publication Data

US 2009/0199601 A1 Aug. 13, 2009

(30) Foreign Application Priority Data

Feb. 12, 2008 (KR) ..... 10-2008-0012575

(51) Int. Cl.

| | |
|---|---|
| ***D06F 39/08*** | (2006.01) |
| ***D06F 39/12*** | (2006.01) |
| ***D06F 39/10*** | (2006.01) |
| ***D06F 37/22*** | (2006.01) |

(52) U.S. Cl.

CPC ..... *D06F 39/125* (2013.01); *D06F 37/22* (2013.01); *D06F 39/083* (2013.01); *D06F 39/085* (2013.01); *D06F 39/10* (2013.01); *D06F 39/12* (2013.01)

(58) Field of Classification Search

CPC ..... D06F 39/125

See application file for complete search history.

(56) References Cited

U.S. PATENT DOCUMENTS

| | | | | |
|---|---|---|---|---|
| 2,161,022 | A * | 6/1939 | De Marco | 68/53 |
| 4,168,615 | A | 9/1979 | Condit | 68/207 |
| 8,028,548 | B2 * | 10/2011 | Woo et al. | 68/12.13 |
| 2003/0051515 | A1 * | 3/2003 | Woo et al. | 68/20 |
| 2004/0221624 | A1 * | 11/2004 | Fumagalli | 68/17 R |
| 2004/0226320 | A1 * | 11/2004 | Bongini | 68/3 R |
| 2005/0028565 | A1 * | 2/2005 | Ackermann et al. | 68/24 |
| 2007/0102028 | A1 * | 5/2007 | Yoon et al. | 134/56 D |
| 2009/0007602 | A1 * | 1/2009 | Woo et al. | 68/208 |
| 2009/0008527 | A1 * | 1/2009 | Baron | 248/638 |

FOREIGN PATENT DOCUMENTS

| | | | | |
|---|---|---|---|---|
| CN | 1542208 | | 11/2004 | |
| CN | 1580363 | | 2/2005 | |
| CN | 1969076 | | 5/2007 | |
| DE | 10055918 | | 5/2002 | |
| EP | 1233100 | A1 * | 8/2002 | D06F 39/12 |
| EP | 1 505 192 | | 2/2005 | |
| EP | 1 584 729 | | 10/2005 | |

(Continued)

OTHER PUBLICATIONS

Machine translation of KR10-2007-0006371 to Park.*

(Continued)

*Primary Examiner* — Michael Barr
*Assistant Examiner* — Jason Riggleman
(74) *Attorney, Agent, or Firm* — Ked & Associates, LLP

(57) ABSTRACT

A laundry treating device is disclosed, which includes a cabinet that defines an exterior appearance of the device, a tub installed in the cabinet, a lower water holding part recessed in a lower portion of the tub to form a predetermined space, and a water drain hose connected with a side surface of the lower water holding part. The laundry treating device is capable of providing a sufficient water drain height, with improved inner space utilization.

14 Claims, 4 Drawing Sheets

(56) References Cited

FOREIGN PATENT DOCUMENTS

| | | | | | |
|---|---|---|---|---|---|
| EP | 1 726 703 | A1 | | 11/2006 | |
| GB | 800007 | | | 8/1958 | |
| GB | 2 038 372 | A | | 7/1980 | |
| GB | 2038372 | A | * | 7/1980 | ..... D06F 39/08 |
| JP | 10-263284 | A | * | 10/1998 | ..... D06F 39/04 |
| JP | 10263284 | A | * | 10/1998 | ..... D06F 39/04 |
| JP | 2007-105150 | | | 4/2007 | |
| KR | 20-1993-0002758 | | | 2/1993 | |
| KR | 10-2001-0093876 | | | 10/2001 | |
| KR | 10-2002-0076664 | | | 10/2002 | |
| KR | 10-0437784 | | | 6/2004 | |
| KR | 10-2005-0059275 | | * | 1/2007 | ..... D06F 39/08 |
| KR | 10-2005-0059278 | | * | 1/2007 | ..... D06F 39/08 |
| KR | 10-2007-0000189 | A | * | 1/2007 | ..... D06F 37/04 |
| KR | 10-2007-0003356 | | | 1/2007 | |
| KR | 10-2007-0059275 | | * | 1/2007 | ..... D06F 39/08 |
| KR | 2007003359 | A | * | 1/2007 | ..... D06F 39/08 |
| KR | 10-0778693 | | | 11/2007 | |
| RU | 2 225 823 | | | 9/2003 | |
| UA | 50637 | | | 10/2002 | |
| UA | 57799 | | | 7/2003 | |
| UA | 10648 | | | 11/2005 | |
| WO | WO 2004/055254 | | | 7/2004 | |
| WO | WO2006/043775 | A1 | * | 4/2006 | ..... D06F 39/08 |

OTHER PUBLICATIONS

English Machine Translation of10-2005-0059278 to Chang.*
English Machine Translation of10-2007-0059275 to Chang.*
English machine translation of KR10-2007-0000189A by KIPO.*
English Machine Translation of 10-2005-0059275.*
Russian Office Action dated Jan. 24, 2011. Application No. 2010137856/12 (053884).
Chinese Office Action dated Feb. 23, 2012. (with translation).
Ukraine Notice of Allowance issued in Appln. No. 201010878 dated Aug. 9, 2012 (w/ full English translation).
European Search Report issued in Application No. 08872331.7 dated Oct. 22, 2014.
Mexican Search Report dated Nov. 6, 2014, issued in Application No. MX/a/2010/008815 (with English translation).
International Search Report and Written Opinion dated Oct. 6, 2010. (Application No. PCT/KR2008/006222).

* cited by examiner

LAUNDRY TREATING DEVICE

CROSS-REFERENCE TO RELATED APPLICATION

This application claims priority to Korean Patent Application No. 10-2008-0012575, filed in Korea on Feb. 12, 2008, which is hereby incorporated by reference as if fully set forth herein.

BACKGROUND

1. Field

A laundry treating device is disclosed herein.

2. Background

Laundry treating devices are known. However, they suffer from various disadvantages.

BRIEF DESCRIPTION OF THE DRAWINGS

Embodiments will be described in detail with reference to the following-drawings in which like reference numerals refer to like elements, and wherein.

DETAILED DESCRIPTION

Reference will now be made in detail to embodiments, examples of which are illustrated in the accompanying drawings. Wherever possible, like reference numbers will be used throughout the drawings to refer to the same or like parts.

Washing machines typically remove dirt from items (hereinafter referred to as laundry) through washing, rinsing and spinning cycles. Such washing machines may be categorized into drum types, agitator types, and pulsator types.

In an agitator type washing machine, an agitator which has a blade is rotated in right and left directions to perform washing. In a pulsator type washing machine, a pulsator is rotatably agitated and creates water flow to perform washing.

In a drum type washing machine, wash liquid, detergent, and laundry are mixed together inside of a cylinder-shaped drum having a plurality of projected portions, which is about a horizontal shaft at a relatively low speed. Hence, the laundry is lifted and dropped by the plurality of projected portions, and thus, the laundry is washed by being lifted and dropped and the friction force between laundry items. This type of washing has the advantages of less fabric damage and of less water consumption, and accordingly, there has been an increased demand for the drum type washing machine.

On the other hand, dryers are electric appliances that dry wet laundry. Recently, combination laundry devices having both washing and drying functions have been produced. Henceforth, the combination laundry device having both washing and drying functions will be referred to as a laundry treating device for convenience sake.

Such a laundry treating device may be categorized, based on the way in which laundry is introduced, as, for example, a top loading type or a front loading type.

The laundry treating device may include a water drain device that drains water from a tub after washing, rinsing, and spinning cycles are complete. For example, a water drain hose may be provided connected with a water drain hole in the tub and a water drain pump that pumps water to be drained.

The water drain hole of the tub should be at a sufficient height, such that the water draining is performed smoothly, dirt does not remain in the tub, and water from the tub does not flow backward.

Thus, there exists a demand for a structure capable of providing an appropriate height of the water drain in a limited inner space of a laundry treating device. In particular, it becomes more important for there to be sufficient water drain height in the case where a predetermined structure is provided in a lower portion of the laundry treating device.

Figure 1:
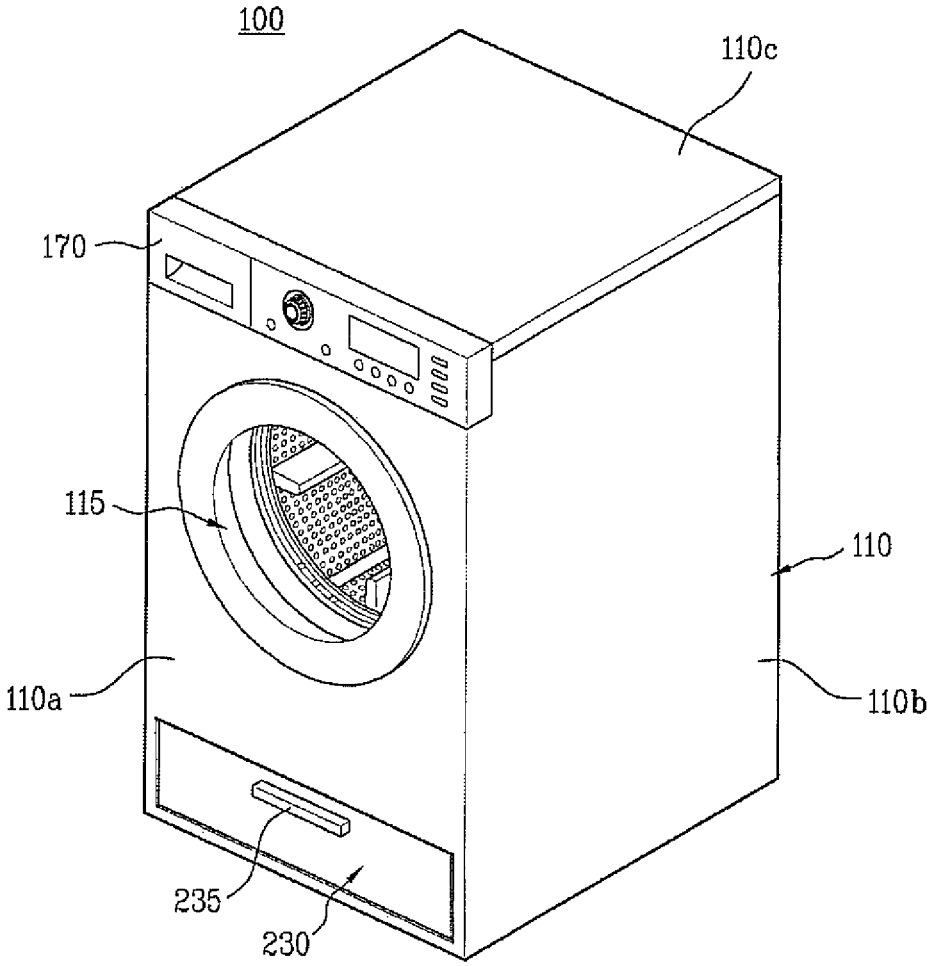
FIG. 1 is a front perspective view of a laundry treating device according to an embodiment.
Figure 2:
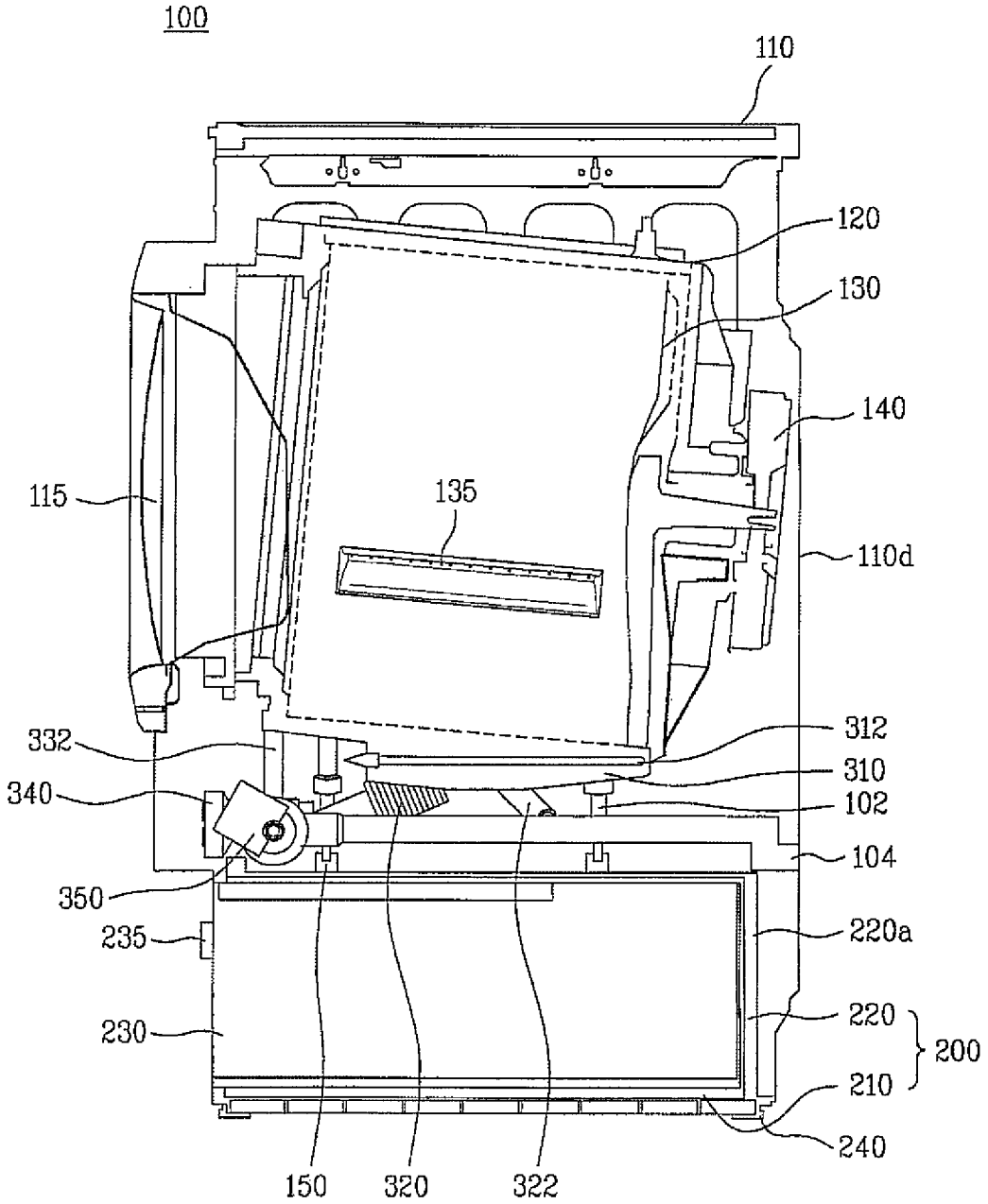
FIG. 2 is a side sectional view of FIG. 1.
Figure 3:
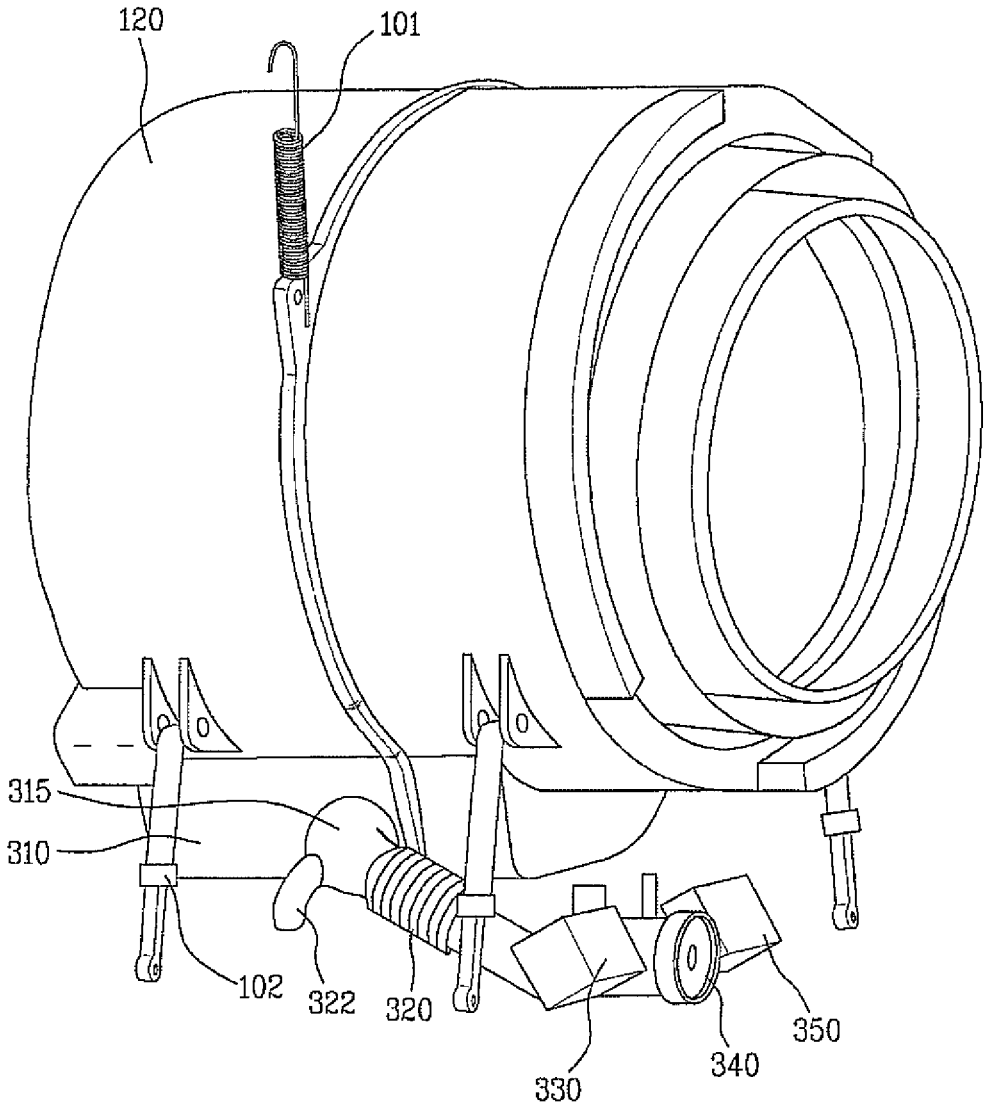
FIG. 3 is a front perspective view of a water drain structure provided in the laundry treating device of FIG. 1.
Figure 4:
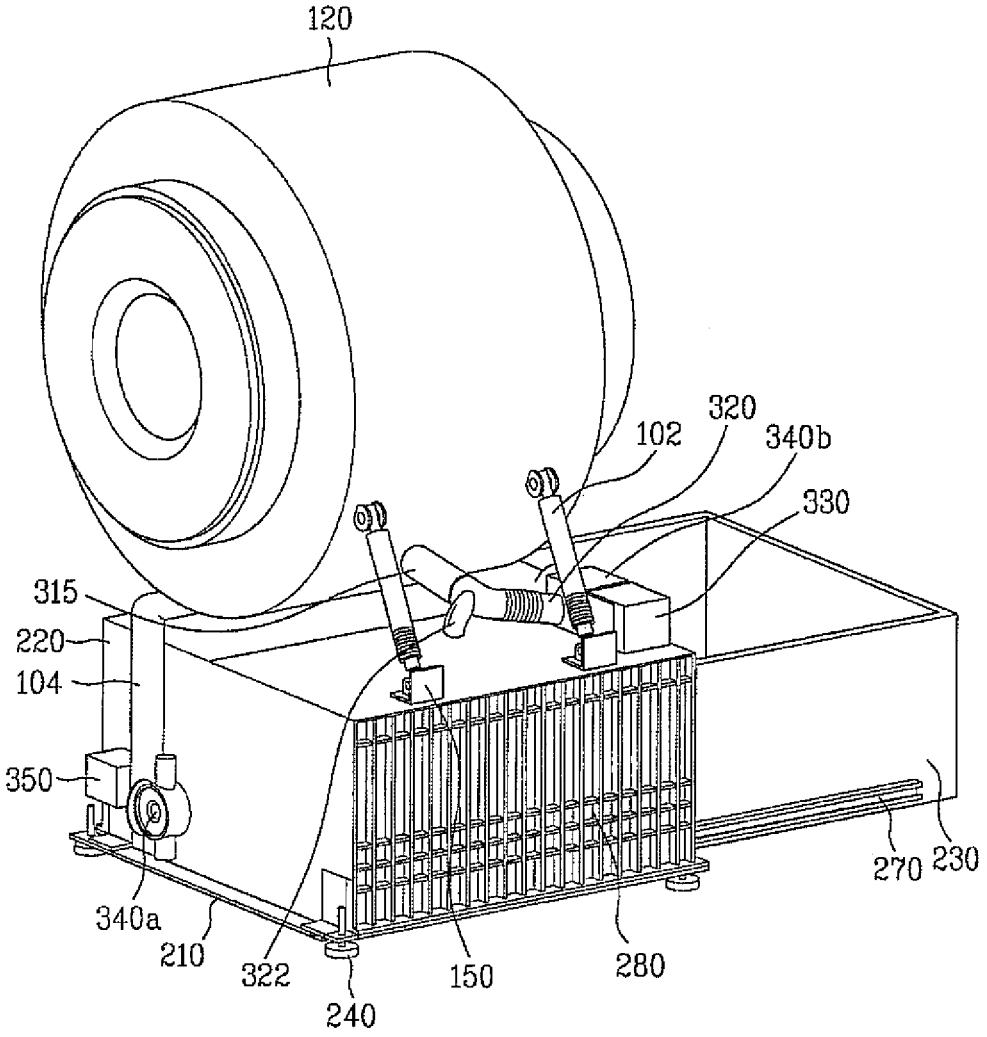
FIG. 4 is a rear perspective view of a laundry treating device according to another embodiment.

FIG. 1 is a front perspective view of a laundry treating device according to an embodiment. FIG. 2 is a side sectional view of the laundry treating device of FIG. 1. FIG. 3 is a front perspective view of a water drain structure provided in the laundry treating device of FIG. 1. FIG. 4 is a rear perspective view of a laundry treating device according to another embodiment.

Referring to FIGS. 1 to 4, laundry treating device 100 may include a cabinet 110, a tub 120, a lower water holding part 310, and a water drain hose 320. The cabinet 110 may define an exterior appearance of the laundry treating device 100 and the tub 120 may be installed in the cabinet 110. At least some of an inner lower portion of the tub 120 may be recessed to form the lower water holding part 310. The water drain hose 320 may be connected with a side surface of the lower water holding part 310.

More specifically, the laundry treating device 100 may further include a movable housing or movable part 230 positioned under the tub 120 and a casing 200 that forms a predetermined space that receives the movable housing 230. As set forth below, the movable housing 230 may be in various forms, such as a drawer type structure. The cabinet 110 may include a front cover 110*a* that defines a front of the laundry treating device 100, a side cover 110*b* that defines a side thereof, and a top cover 110*c* that defines a top thereof.

A door 115 may he coupled to the front cover 110*a* and laundry may be loaded into or unloaded from the cabinet 110 through the door 115. In addition, a control panel 170 may be installed at the front cover to control the laundry treating device. A front opening (not shown) may be formed in the front cover and the movable housing 230 may be introduced into and withdrawn from the laundry treating device through the front opening (not shown).

In this embodiment, the tub 120 is disclosed as part of a drum type washing machine. However, the tub 120 may be an inner tub or outer tub in a pulsator type washing machine or it may be a drum in a drum type washing machine. Other applications may also be appropriate.

In the drum type washing machine, as shown in FIGS. 1 and 2, the tub 120 may be provided in the cabinet 110 and a drum 130 may be provided rotatable within the tub 120. An upper portion of the tub 120 may be supported by a suspension device, such as a spring 101, and a lower portion of the tub 120 may be supported by a damping device, such as a damper 102. The spring 101 may connect an upper portion of the tub 120 with a top of the cabinet 110. The damper 102 may connect a lower portion of the tub 120 with the casing 200 or the cabinet 110.

Embodiments are not limited to this structure. The tub 120 may be fixedly formed as one body with the cabinet 110. Alternatively, the tub 120 may be installed so as to move relative to the drum 130.

A motor 140 may be provided in the cabinet 110 to rotate the drum 130. A plurality of lifts 135 may be provided on an inner circumferential surface of the drum 130 to wash the laundry. When the drum 130 is rotated, the lifts 135 may lift and drop the laundry to apply a friction force and shock to the laundry.

A water supply pipe (not shown) that supplies water to the tub 120, and a water drain pipe 104 that drains the water in the tub 120 to the outside of the laundry treating machine may be provided in the cabinet 110. When washing starts, water may be supplied to the tub 120 from outside through the water supply pipe (not shown). When washing is complete, the water held in the tub 120 may be drained outside through the water drain pipe 104.

The movable housing 230 may be held in the casing 200 installed under the tub 120 and it may be movable in a forward and backward direction with respect to the cabinet 110. A grip 235 may be provided on a front surface of the movable housing 230 that allows a user to slidingly move the movable housing 230.

The movable housing 230 may be embodied in various forms or types. For example, the movable housing 230 may be configured as a drawer to store items, or it may be configured as a dryer or washer having a relatively low height. Embodiments are not limited to the above types, and thus, the movable housing 230 may have various functions.

If the movable housing 230 is configured as a drawer, a user may store items, such as detergent and laundry items, in the drawer. As a result, the user may use the laundry treating device 100 in a convenient way.

If the movable housing 230 is configured as a dryer or washer, the user may employ either a washer or dryer in an upper portion and dispose the other in a lower portion as the movable housing 230. Alternatively, any small sized electric appliances, including those having no relationship with washing or drying clothes or related items, may be embodied as the movable housing 230.

The casing 200 may be provided in the cabinet 110 to heighten an installation position of the tub 120 and to form a predetermined space that holds the movable housing 230. The damper 102 may be installed on a top of the casing 200 to support the tub 120. More specifically, the damper 102 may be supported by a damper supporter 150 provided on the top of the casing 200.

A rear surface 220*a* of the casing 200 may be coupled to a rear wall 110*d* of the cabinet 110 by a securing device (not shown). The securing device may include a securing bushing (not shown) provided at the rear surface 220*a* of the casing 200 and a securing member (not shown) that couples the casing 200 to the cabinet 110. The securing member (not shown) may be, for example, a transit bolt which may be coupled to the securing bushing to secure the casing 200 to the cabinet 110.

The casing 200 may be embodied in various forms or types. For example, the casing 200 may include a lower base 210 that forms a lower surface of the cabinet 110 and an upper base 220 that forms an accommodation space for the movable housing 230 together with the lower base 210. As shown in FIG. 2, the casing 200 may include the lower base 210 and the upper base 220 installed on the lower base 210 to accommodate the movable housing 230 together with the lower base 210.

The upper base 220 may provide a predetermined distance between the tub 120 and the lower base 210 to heighten a position of an opening of the tub 120 through which laundry may be loaded into drum 130. The upper base 220 may be employed to partition a predetermined space in the casing 200 into spaces for the tub 120 and the movable housing 230. As a result, the position of the opening of the tub 120 may be heightened, and when using the laundry treating device 100, a user may put laundry into and take laundry from the tub 120 without bending his/her waist a significant amount.

The lower base 210 may be installed in a lower portion of the cabinet 110 to define a bottom of the cabinet 110. Alternatively, a separate lower case may be provided in the cabinet 110 to define the bottom of the cabinet 110 and the lower case may be coupled to the lower base 210. The casing 200 may be formed as one body with the cabinet 110 and a supporting member 240 may be provided at a corner of an outer lower surface of the lower case or the lower base 210 to support the laundry treating device 100.

A reinforcement rib (not shown) may be formed on the casing 200, that is, an upper surface of the upper base 220 to reinforce the strength of the casing 200. In addition, a side reinforcement rib 280 may be provided at a side surface of the upper base 220 to reinforce the strength of the casing 200. Further, a plurality of side reinforcement ribs 280 may be provided uniformly at the side surface of the upper base 220.

A guide rail 270 may be provided at an inner side surface of the upper base 220 to guide the sliding motion of the movable housing 230. A guide protrusion (not shown) may be provided at the side surface of the movable housing 230 corresponding to each of the guide rails 270. As a result, if the movable housing 230 is provided to slide in the casing 200, the guide rail 270 may be provided corresponding to the guide protrusion to guide the motion of the movable housing 230.

As mentioned above, the laundry treating device 100 may include the lower water holding part 310 formed by the recessed portion of the lower portion of the tub 120 and the water drain hose 320 connected with the side surface of the lower water holding part 310. The lower water holding part 310 is substantially a predetermined space formed in the lower portion of the cylindrical tub 120, and it may be formed in various forms or appearances. Here, a heater 312 may be installed in the lower water holding part 310 to heat water held in the tub 120.

The side surface of the lower water holding part 310 may be inclined substantially perpendicular to a bottom thereof or inclined almost perpendicular. The water drain hose 320 may be connected to the side surface of the lower water holding part 310. Further, the water drain hose 320 may be formed as one body with an air chamber 322 provided to measure a water level of the tub 120 by, for example, sensing pressure changes in the water discharged through the water drain hose 320. An end of the air chamber 322 may be connected with a sending line (not shown) and a pressure sensor (not shown) connected with the sending line may calculate pressure change values to measure the water level in the tub 120.

The water drain hose 320 may be connected with the lower portion of the tub 120, along a lateral direction of the tub 120, between the tub 120 and the movable housing 230, to secure a predetermined height so that the water of the tub 120 is drained. Even if the movable housing 230 is not provided under the tub 120, the water drain hose 320 may be connected to the lower portion of the tub 120, along the lateral direction of the tub 120, to provide a sufficient height for water drain.

If the lower water holding part 310 is not provided in the tub 120, the water drain hose 320 may be connected with the lower portion of the tub 120, along the lateral direction of the tub 120. Viewed from the front, the lower portion of the cylindrical tub 120 may have a semi-circular appearance. As a result, the water drain hose 320 may be connected along a lateral direction of the tub 120 at a position a little bit higher than the lowest end of the tub 120. In this case, a vertical partition (not shown) may be installed in an inner bottom of the tub 120 to prevent water from remaining in a space in the tub 120 that is lower than the water drain hose 320.

As shown in FIG. 4, a connection 315 may be extended from the lower portion of the tub 120 along a lateral direction of the tub 120 and the water drain hose 320 may be connected with the connection 315. More specifically, the connection 315 may be extended from the lower portion of the tub 120 along a lateral direction of the tub 120. Here, the connection 315 may extend substantially parallel to the installation surface of the tub 120 or it may be inclined downward along the lateral direction. The connection 315 may be extended from the bottom of the tub 120 as one body with the tub 120, or a separate member may be, for example, welded, attached, or coupled to the tub 120.

As mentioned above, if the connection 315 is connected with the bottom of the tub 120 without the lower water holding part 310, the connection 315 may be connected at a little bit higher portion than the bottom in the lateral direction. Even in this case, a horizontal partition may be installed at an inner bottom of the tub 120 to prevent water from remaining in an inner space of the tub 120 that is lower than the connection 315.

If the water drain hose 320 is connected with the bottom of the tub 120 in the lateral direction of the tub 120, a sufficient height of water drain may be provided in any circumstances. Thus, the lower portion of the tub 120 may be utilized more efficiently.

Especially, even in the case that the movable housing 230 and the casing 200 that holds the movable housing 230 are provided under the tub 120, a sufficient water drain height may be provided to drain the water from the tub 120 smoothly, with optimal utilization of the area or portion under the tub 120.

The laundry treating device 100 may include a water drain pump 350 that drains water from the tub 120 through the water drain hose 320. The water drain pump 350 may be positioned at a front portion above the casing 200. In this case, water discharged from the tub 120 through the water drain hose 320 may be pumped by the water drain pump 350 and guided along the water drain pipe 104 to the rear surface 110*d* of the cabinet 110 to be discharged outside thereof Since the water drain hose 320 is connected with the side surface of the lower water holding part 310, a sufficient water drain height may be provided, such that water may be prevented from flowing backward and washing dirt may be prevented from remaining in the tub 120.

According to another embodiment, a water drain pump 350 of a laundry treating device 100 may be positioned in a rear lower portion of the movable housing 230 to heighten the installation position of the movable housing 230, as well as to perform the water draining smoothly. More specifically, as shown in FIG. 4, if the water drain pump 350 is installed in the rear portion of the casing 200 which holds the movable housing 230, a vertical height of the casing 200 may be increased as much as a vertical height of the water drain pump 350. As a result, the vertical height of the movable housing 230 may be increased. In addition, as the water drain pump 350 is installed in the lower portion in the rear portion of the casing 200, water in the tub 120 may be drained more smoothly.

In the meantime, a circulation pump 330 may be installed below the tub 120, for example, in a front portion of the casing 200 to circulate water. As shown in FIG. 3, a drain filter 340 may be provided to filter foreign substances contained in the wash water discharged from the tub 120. The water drain hose 320 may be connected with the water drain filter 340. In the embodiment of FIG. 4, with respect to the water drain filter 340, a predetermined portion 340*a* may be connected with the water drain pump 350 and another portion 340*b* may be connected with the circulation pump 330.

A circulation pipe 332 may be connected with the circulation pump 330. Once the circulation pump 330 is operated, water in the tub 120 may be discharged outside thereof and re-supplied to the tub 120 by the circulation pipe 332. The water in the tub 120 may be re-supplied to the tub 120 by pumping the water of the tub 120 to create various water currents in the tub 120 and shock and friction force by the supply of the water, such that washing and rinsing efficiency may be enhanced.

As shown in FIG. 4, the circulation pump 330 may be provided in the front portion of the casing 200 and the water drain pump 350 may be provided in the rear portion of the casing 200. Further, the water drain filter 340*b* may be exposed to the outside when the movable housing 230 is moved outward from the cabinet 110, such that a user may have easy access to the water drain filter 340*b* to replace it with a new filter as needed. That is, as shown in FIGS. 2 to 4, the water drain filter 340, 340*b* may be installed in a front portion on the casing 200 for easy user access.

A laundry treating device according to embodiments may have at least the following advantages.

First, a sufficient height for the water drain may be provided, because the water drain hose may be connected with the lower portion of the tub along the lateral direction of the tub.

Second, even if the movable housing and the casing that holds the movable housing are provided under the tub, a sufficient height for water drain may be provided optimizing utilization of the lower space. As a result, the water may be drained from the tub smoothly.

Third, water may not flow backward and washing dirt may not remain in the tub during the draining of the water held in the tub. As a result, product reliability may be enhanced.

Embodiments disclosed herein are directed to a laundry treating device which is capable of providing a sufficient water drain height, with improved inner space utilization.

Embodiments disclosed herein provide a device for treating laundry that may include a cabinet to define an exterior appearance of the device, a tub installed in the cabinet, a lower water holding part recessed in a lower portion of the tub to form a predetermined space, and a water drain hose connected with a side surface of the lower water holding part. The device may further include a movable housing or part provided under the tub, the movable part being movable in a forward and backward direction from the cabinet. The device may further include a casing or housing to form a predetermined space in which the movable part may be held and to heighten an installation position of the tub from a floor.

Further, a water drain pump may be provided to drain water from the tub through the water drain hose. The water drain pump may be positioned in a front portion on the housing. The water drain pump may be positioned in a lower portion in a rear of the housing.

The device may further include an air chamber formed as one body with the water drain hose to sense pressure changes of the water discharged through the water drain hose, and a sending line connected with an end of the air chamber, being connected with a pressure sensor that calculates values of the pressure changes. The device may further include a circulation pump to circulate the water of the tub and a water drain filter to filter foreign substances contained in the water discharged from the tub.

Embodiments disclosed herein further provide a device for treating laundry that may include a cabinet to define an exterior appearance of the device, a tub installed in the cabinet, a movable part provided under the tub, the movable part being movable in a forward and backward direction of the cabinet, and a water drain hose connected with a bottom of the tub along a lateral direction between the tub and the movable part to secure a predetermined height for draining the water of the tub.

Embodiments disclosed herein further provide a device for treating laundry that may include a cabinet to define an exterior appearance of the device, a tub installed in the cabinet, a connection extended from a bottom of the tub in a lateral direction, and a water drain hose connected with the connection. The connection may be extended in a lateral direction, being substantially horizontal to a tub installation surface. The connection may be extended with an oblique inclined downward.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating device, comprising:

a cabinet that defines an exterior appearance of the laundry treating device;

a tub installed in the cabinet;

a lower water holding part formed as a recess in a lower portion of the tub to form a predetermined space, the lower water holding part including a bottom surface and a plurality of side surfaces, at least one of the plurality of side surfaces being substantially perpendicular to the bottom surface;

a water drain hose connected to one of the plurality of side surfaces of the lower water holding part, wherein the one of the plurality of side surfaces of the lower water holding part connected to the water drain hose is inclined substantially perpendicular to the bottom surface of the lower water holding part;

a movable housing provided under the tub, the movable housing being movable in forward and backward directions with respect to the cabinet; and a casing that forms a predetermined space in which the movable housing is received, wherein the tub is installed on and supported by a top of the casing so as to elevate the tub with respect to a surface on which the laundry treating device is installed, and wherein the water drain hose is disposed between the lower water holding part and the casing.

2. The laundry treating device of claim 1, further comprising a water drain pump that drains water from the tub through the water drain hose.

3. The laundry treating device of claim 2, wherein the water drain pump is positioned at a front portion of the casing.

4. The laundry treating device of claim 2, wherein the water drain pump is positioned at a lower rear portion of the casing.

5. The laundry treating device of claim 1, further comprising:

an air chamber formed as one body with the water drain hose, that senses pressure changes in the water discharged through the water drain hose; and a sending line connected with an end of the air chamber and having a pressure sensor that calculates values of the pressure changes.

6. The laundry treating device of claim 1, further comprising a circulation pump that circulates water in the tub.

7. The laundry treating device of claim 1, further comprising a water drain filter that filters foreign substances contained in water discharged from the tub.

8. The laundry treating device of claim 1, further comprising a heater installed in the lower water holding part to heat water in the rub.

9. The laundry treating device of claim 1, further comprising a water drain pipe in communication with the water drain hose at a front portion of the cabinet, wherein the water drain pipe extends from the front portion of the cabinet to the rear portion of the cabinet, wherein the water drain pipe communicates with an outside of the tub at the rear portion of the cabinet, and wherein the water drain pipe is disposed between the tub and the top of the casing.

10. The laundry treating device of claim 1, wherein the movable housing comprises a drawer.

11. The laundry treating device of claim 1, further comprising a plurality of dampers disposed between the tub and the top of the casing.

12. The laundry treating device of claim 11, wherein the plurality of dampers is supported by a plurality of damper supporters provided at the top of the casing.

13. The laundry treating device of claim 1, wherein the casing includes a plurality of reinforcing ribs that reinforce a strength of the casing.

14. The laundry treating device of claim 1, wherein the water drain hose extends in the forward direction.

* * * * *